US008721137B1

(12) United States Patent
Chien

(10) Patent No.: US 8,721,137 B1
(45) Date of Patent: May 13, 2014

(54) ANGLE-ADJUSTABLE HAND-HELD LAMP

(71) Applicant: Chao-Chuan Chien, New Taipei (TW)

(72) Inventor: Chao-Chuan Chien, New Taipei (TW)

( * ) Notice: Subject to any disclaimer, the term of this patent is extended or adjusted under 35 U.S.C. 154(b) by 4 days.

(21) Appl. No.: 13/727,752

(22) Filed: Dec. 27, 2012

(51) Int. Cl.
*F21V 21/08* (2006.01)

(52) U.S. Cl.
USPC ..... 362/400; 362/185; 362/186; 362/188

(58) Field of Classification Search
USPC ..... 362/399, 400, 184, 185, 186, 188, 285, 362/287
See application file for complete search history.

(56) References Cited

U.S. PATENT DOCUMENTS

| | | | | | |
|---|---|---|---|---|---|
| 4,249,233 | A * | 2/1981 | Gatton | ..... | 362/103 |
| 4,321,660 | A * | 3/1982 | Sokol | ..... | 362/368 |
| 4,594,647 | A * | 6/1986 | Dippert | ..... | 362/376 |
| 5,072,352 | A * | 12/1991 | Rosenschein | ..... | 362/400 |
| 7,229,185 | B1 * | 6/2007 | Galvez et al. | ..... | 362/109 |
| 7,311,424 | B1 * | 12/2007 | McCarthy | ..... | 362/376 |
| 7,806,548 | B1 * | 10/2010 | Ayala | ..... | 362/119 |

* cited by examiner

*Primary Examiner* — Ali Alavi
(74) *Attorney, Agent, or Firm* — Guice Patents PLLC

(57) ABSTRACT

The present invention discloses an angle-adjustable hand-held lamp, which comprises a support, a protection cover, a first angle adjusting device, a second angle adjusting device, a base, a handle, a threaded joint, a bottom housing and a lamp bulb; the illumination angle of the lamp bulb is enabled to be adjusted through the first angle adjusting device and the second angle adjusting device.

9 Claims, 4 Drawing Sheets

ANGLE-ADJUSTABLE HAND-HELD LAMP

BACKGROUND OF THE INVENTION

1. Field of the Invention

The present invention relates to a hand-held lamp, especially to an angle-adjustable hand-held lamp installed with a first angle adjusting device and a second angle adjusting device for adjusting the illumination angle of the hand-held device.

2. Description of Related Art

Referring to FIG. 1, which is a schematic view illustrating the assembly of a conventional hand-held lamp. As shown in FIG. 1, the conventional hand-held lamp comprises a handle 100, an electric wire 110, a base 120, a lamp 130, a protection net 140 and a hook 150. The hook 150 is used for hanging the hand-held lamp at a location such as being hanged on a wall, a tree or in a working place such as the engine chamber of a vehicle. Wherein, the lamp 130 is fixed in the base 120, the handle 100 is not installed with an angle adjusting mechanism; as such, the hand-held lamp can only provide a light source with a fixed angle and a fixed illuminating direction.

Take the hand-held lamps disclosed in the U.S. Pat. No. 6,727,664, the U.S. Pat. No. 7,274,153 and the U.S. Pat. No. 7,367,698 for examples, the disclosed lamps are not installed with an angle adjusting mechanism, thereby only being able to provide a light source with a fixed angle and a fixed illuminating direction. The mentioned shortage of not having an angle adjusting mechanism shall be improved.

SUMMARY OF THE INVENTION

One primary objective of the present invention is to provide an angle-adjustable hand-held lamp installed with a first angle adjusting device and a second angle adjusting device for adjusting the illumination angle of the hand-held device.

For achieving the aforesaid objective, the angle-adjustable hand-held lamp provided by the present invention comprises: a support, two sides thereof are respectively formed with a first opening; a protection cover, two sides thereof are respectively formed with a second opening, the bottom thereof is formed with a fasten ring, and two sides of the fasten ring are respectively formed with a third opening; a first angle adjusting device fastened at one side of the fasten ring and the support; a second angle adjusting device fastened at the other side of the fasten ring and the support; a base formed with a wire hole allowing an electric wire to pass; a handle formed with a wire hole allowing the electric wire to pass and fastened with the base; a threaded joint disposed in the base and coupled to the electric wire; a bottom housing disposed at an outer side of the threaded joint; and a lamp bulb secured in the threaded joint; the illumination angle of the lamp bulb is enabled to be adjusted through the first angle adjusting device and the second angle adjusting device.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
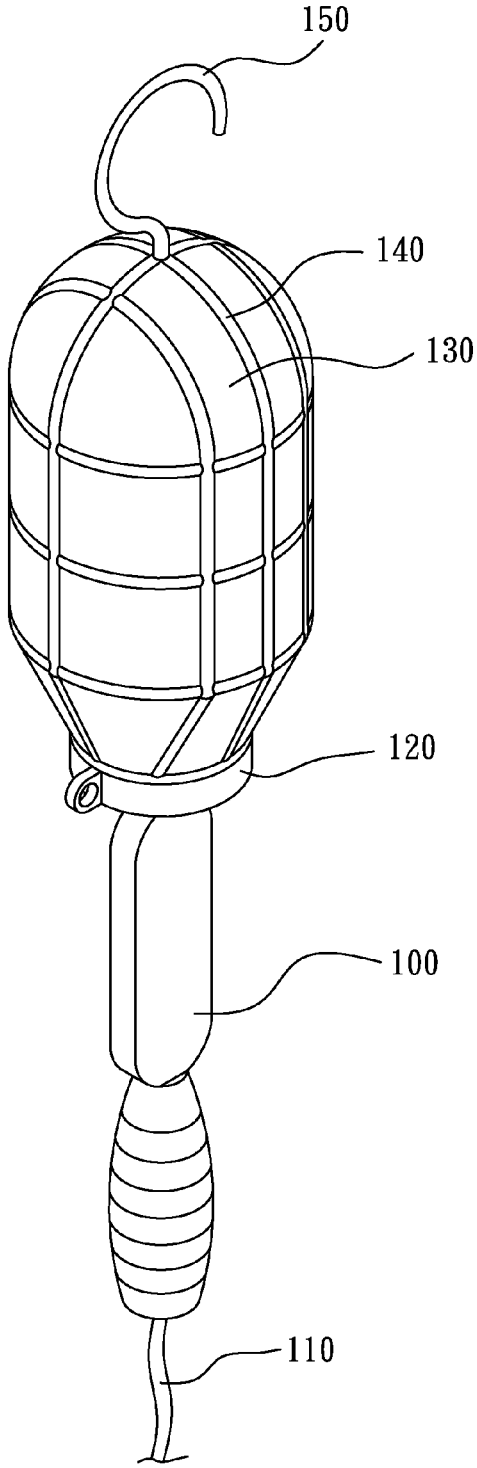
(PRIOR ART) FIG. 1
FIG. 1 is a schematic view illustrating the assembly of a conventional hand-held lamp.
Figure 2:
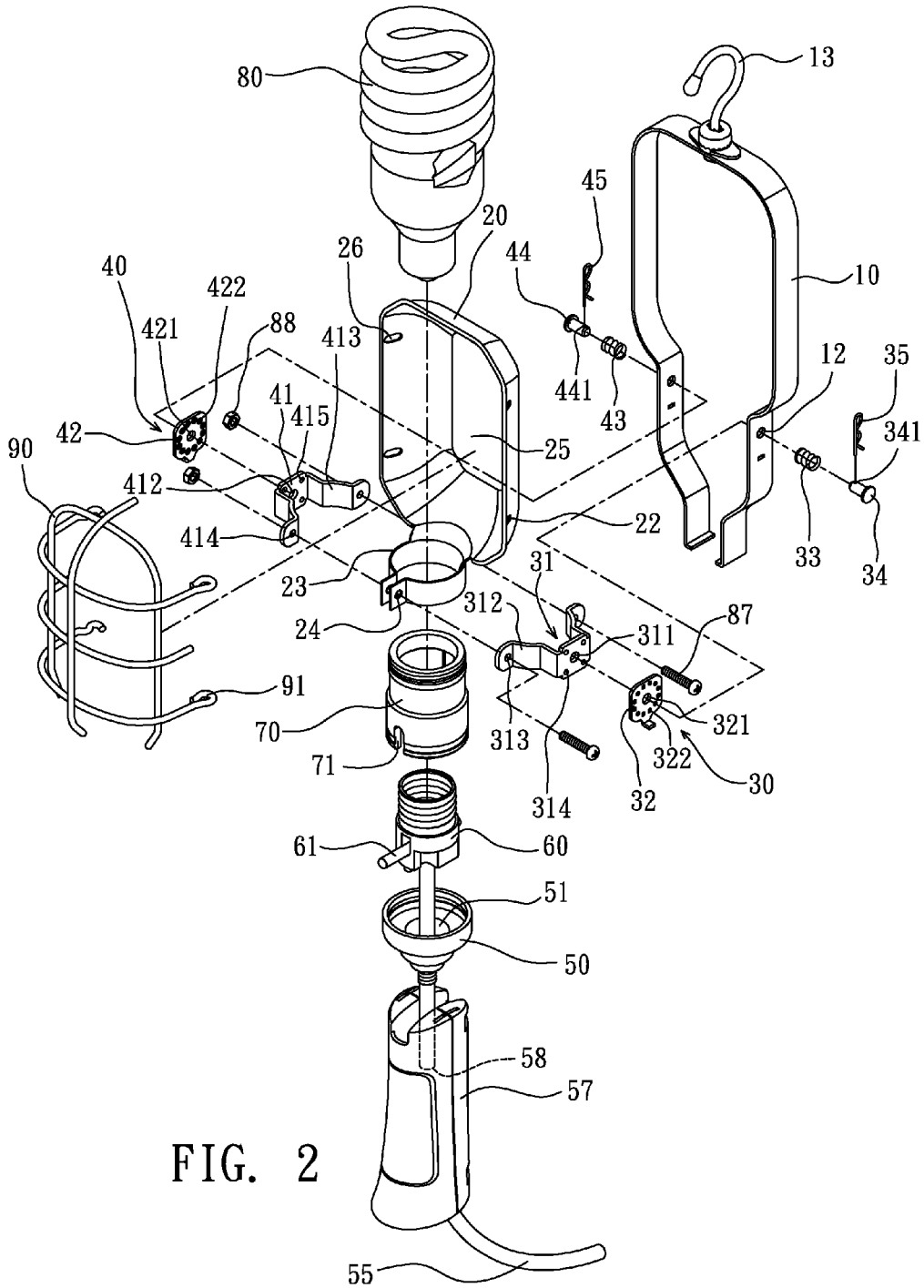
FIG. 2 is an exploded view illustrating the angle-adjustable hand-held lamp, according to one preferred embodiment of the present invention.
Figure 3:
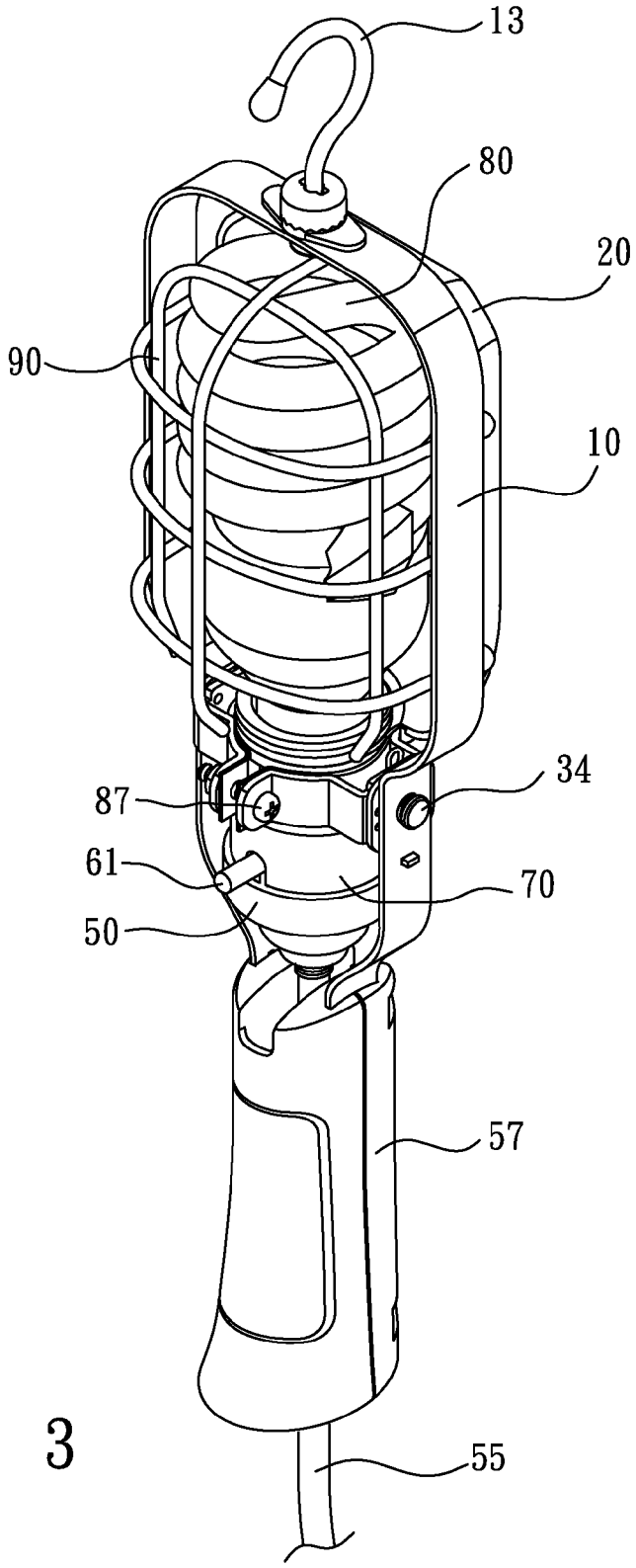
FIG. 3 is a schematic view illustrating the assembly of the angle-adjustable hand-held lamp, according to one preferred embodiment of the present invention.
Figure 4:
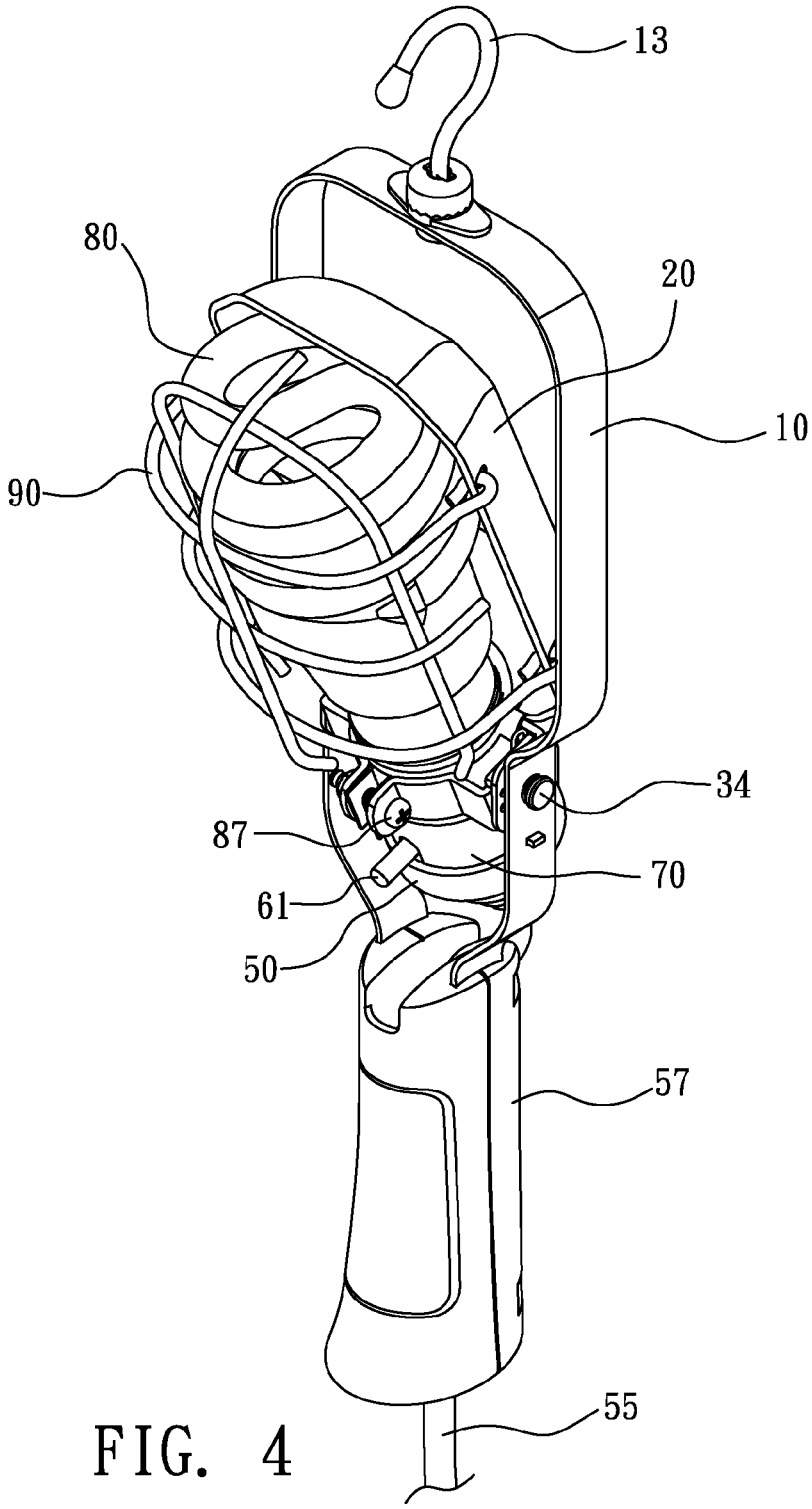
FIG. 4 is a schematic view illustrating the angle-adjustable hand-held lamp being adjusted to a fixed angle, according to one preferred embodiment of the present invention.

Referring from FIG. 2 to FIG. 4, wherein FIG. 2 is an exploded view illustrating the angle-adjustable hand-held lamp, according to one preferred embodiment of the present invention; FIG. 3 is a schematic view illustrating the assembly of the angle-adjustable hand-held lamp, according to one preferred embodiment of the present invention; and FIG. 4 is a schematic view illustrating the angle-adjustable hand-held lamp being adjusted to a fixed angle, according to one preferred embodiment of the present invention.

As shown in figures, the angle-adjustable hand-held lamp provided by the present invention comprises a support 10, a protection cover 20, a first angle adjusting device 30, a second angle adjusting device 40, a base 50, a handle 57, a threaded joint 60, a bottom housing 70 and a lamp bulb 80.

The support 10 is e.g. but not limited to be made of a metal material, and two sides thereof are respectively formed with a first opening 12. In addition, the top of the support 10 is further formed with a hook 13, thereby enabling the hand-help lamp to be hanged at a location such as being hanged on a wall, a tree or in a working place such as the engine chamber of a vehicle.

The protection cover 20 is e.g. but not limited to be made of a metal material, two sides thereof are respectively formed with a second opening 22. In addition, the bottom of the protection cover 20 is formed with a fasten ring 23, and two sides of the fasten ring 23 are respectively formed with a third opening 24. Moreover, the protection cover 20 is further installed with a reflection sheet 25, thereby allowing a light source to be reflected from the reflection sheet 25 for increasing the brightness, and two sides of the reflection sheet 25 are further formed with two fasten holes 26.

The first angle adjusting device 30 is fastened on the support 10 through one of the first openings 12 of the support 10 and installed at one side of the fasten ring 23, e.g. but not limited to the right side.

The first angle adjusting device 30 further includes a first lock piece 31, a first fasten piece 32, a first spring 33, a first fasten member 34 and a first tenon 35.

The first lock piece 31 is formed with a fourth opening 311 corresponding to the first opening 12, and two sides of the fourth opening 311 are respectively extended with a wing piece 312 on which a fifth opening 313 is formed, and four sides of the fourth opening 311 are respectively formed with a first protrusion 314.

The first fasten piece 32 is formed with a sixth opening 321 corresponding to the fourth opening 311, and the periphery of the sixth opening 321 is further formed with plural seventh openings 322 corresponding to the first protrusions 314, wherein the first protrusions 314 are capable of being latched in the seventh openings 322 thereby positioning the angle of the lamp bulb 80.

The first fasten member 34 is sleeved with the first spring 33, and formed with an eighth opening 341.

The first tenon 35 is sleeved in the eighth opening 341, thereby fastening the first spring 33 on the first fasten member 34.

The second angle adjusting device 40 is fastened on the support 10 through the other first opening 12 of the support 10 and installed at the other side of the fasten ring 23, e.g. but not limited to the left side.

The second angle adjusting device 40 further includes a second lock piece 41, a second fasten piece 42, a second spring 43, a second fasten member 44 and a second tenon 45.

The second lock piece 41 is formed with a ninth opening 412 corresponding to the first opening 12, and two sides of the ninth opening 412 are respectively extended with a wing piece 413 on which a tenth opening 414 is formed, and four sides of the ninth opening 412 are respectively formed with a second protrusion 415.

The second fasten piece 42 is formed with an eleventh opening 421 corresponding to the ninth opening 412, and the periphery of the eleventh opening 421 is further formed with plural twelfth openings 422 corresponding to the second protrusions 415, wherein the second protrusions 415 are capable of being latched in the twelfth openings 422 thereby positioning the angle of the lamp bulb 80.

The second fasten member 44 is sleeved with the second spring 43, and formed with a thirteenth opening 441.

The second tenon 45 is sleeved in the thirteenth opening 441, thereby fastening the second spring 43 on the second fasten member 44.

Accordingly, the angle of the lamp bulb 80 is enabled to be adjusted through two screws 87 in sequence passing the fifth opening 313, the third opening 24 and the tenth opening 414 then being combined with a nut 88.

The base 50 is e.g. but not limited to be made of a plastic material, and formed with a wire hole 51 allowing an electric wire 55 to pass through.

The handle 57 is e.g. but not limited to be made of a plastic material, formed with a wire hole 58 allowing the electric wire 55 to pass through, and fastened with the base 50.

The threaded joint 60 is disposed in the base 50 and coupled to the electric wire 55, wherein the threaded joint 60 is e.g. but not limited to a E27 joint. In addition, the threaded joint 60 is further installed with a switch 61 used for turning on/off the lamp bulb 80.

The bottom housing 70 is e.g. but not limited to be made of a plastic material, disposed at an outer side of the threaded joint 60, and further formed with an opened slot 71 allowing the switch 61 to be exposed.

The lamp bulb 80 is e.g. but not limited to a fluorescent lamp or LED lamp, and secured in the threaded joint 60.

Furthermore, the angle-adjustable hand-held lamp of the present invention further includes a protection net 90, two sides of the protection net 90 are respectively formed with a reversed hook 91 which can be hooked in the second opening 22 and the fasten hole 26 thereby fastening the protection net 90 in the protection cover 20.

As shown in FIG. 3, when being used, if the illumination angle of the lamp bulb 80 is desired to be adjusted, the support 10 is rotated to a proper angle such that the lamp bulb 80 is enabled to be held and fixed at a proper angle through the first protrusions 314 being latched in the seventh openings 322 and the second protrusions 415 being latched in the twelfth openings 422, thereby achieving the objective of adjusting the illumination angle of the lamp bulb 80.

As what has been disclosed above, the angle-adjustable hand-held lamp of the present invention is installed with a first angle adjusting device and a second angle adjusting device thereby being provided with the advantage of adjusting the illumination angle of the hand-held lamp. Compared to the mentioned conventional hand-held lamp, the angle-adjustable hand-held lamp provided by the present invention is novel and capable of solving the shortages of the prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. An angle-adjustable hand-held lamp, comprising:

a support, two sides thereof being respectively formed with a first opening;

a protection cover, two sides thereof being respectively formed with a second opening, the bottom thereof being formed with a fasten ring, and two sides of said fasten ring being respectively formed with a third opening;

a first angle adjusting device fastened at one side of said fasten ring and said support;

a second angle adjusting device fastened at the other side of said fasten ring and said support;

a base formed with a wire hole allowing an electric wire to pass;

a handle formed with a wire hole allowing said electric wire to pass and fastened with said base;

a threaded joint disposed in said base and coupled to said electric wire;

a bottom housing disposed at an outer side of said threaded joint; and a lamp bulb secured in said threaded joint;

the illumination angle of said lamp bulb being enabled to be adjusted through said first angle adjusting device and said second angle adjusting device.

2. The angle-adjustable hand-held lamp as claimed in claim 1, wherein the top of said support is formed with a hook.

3. The angle-adjustable hand-held lamp as claimed in claim 1, wherein said protection cover is installed with a reflection sheet, and two sides of said reflection sheet are further formed with two fasten holes.

4. The angle-adjustable hand-held lamp as claimed in claim 1, wherein said first angle adjusting device further includes:

a first lock piece, formed with a fourth opening corresponding to said first opening, and two sides of said fourth opening are respectively extended with a wing piece on which a fifth opening is formed, and four sides of said fourth opening are respectively formed with a first protrusion;

a first fasten piece, formed with a sixth opening corresponding to said fourth opening, and the periphery of said sixth opening is further formed with plural seventh openings corresponding to said first protrusions, said first protrusions are capable of being latched in said seventh openings thereby positioning the angle of said lamp bulb;

a first spring;

a first fasten member, sleeved with said first spring, and formed with an eighth opening; and a first tenon, sleeved in said eighth opening.

5. The angle-adjustable hand-held lamp as claimed in claim 4, wherein said second angle adjusting device further includes:

a second lock piece, formed with a ninth opening corresponding to said first opening, and two sides of said ninth opening are respectively extended with a wing piece on which a tenth opening is formed, and four sides of said ninth opening are respectively formed with a second protrusion;

a second fasten piece, formed with an eleventh opening corresponding to said ninth opening, and the periphery of said eleventh opening is further formed with plural twelfth openings corresponding to said second protrusions, said second protrusions are capable of being latched in said twelfth openings thereby positioning the angle of said lamp bulb;

a second spring;

a second fasten member, sleeved with said second spring, and formed with a thirteenth opening; and a second tenon, sleeved in said thirteenth opening;

the angle of said lamp bulb is enabled to be adjusted through two screws in sequence passing said fifth opening, said third opening and said tenth opening then being combined with a nut.

6. The angle-adjustable hand-held lamp as claimed in claim 1, wherein said bottom housing is further formed with an opened slot.

7. The angle-adjustable hand-held lamp as claimed in claim 6, wherein said threaded joint is further installed with a switch disposed in said opened slot and exposed outside said opened slot and used for turning on/off said lamp bulb.

8. The angle-adjustable hand-held lamp as claimed in claim 3, further including a protection net, two sides of said protection net are respectively formed with a reversed hook which is hooked in said second opening and said fasten hole thereby fastening said protection net in said protection cover.

9. The angle-adjustable hand-held lamp as claimed in claim 1, wherein said threaded joint is an E27 joint, said lamp is a fluorescent lamp or a LED lamp.

* * * * *